US006080068A

United States Patent [19]

Takeda

[11] Patent Number: 6,080,068

[45] Date of Patent: Jun. 27, 2000

[54] GOLF CLUB

[75] Inventor: Hitoshi Takeda, Tsubame, Japan

[73] Assignee: Kabushiki Kaisha Endo Seisakusho, Niigata, Japan

[21] Appl. No.: 09/118,125

[22] Filed: Jul. 16, 1998

[30] Foreign Application Priority Data

Dec. 26, 1997 [JP] Japan ..... 9-361289

[51] Int. Cl.[7] ..... A63B 53/02

[52] U.S. Cl. ..... 473/305; 473/307; 473/345; 473/350

[58] Field of Search ..... 473/305–315, 473/345, 346, 349–350, 329, 332; D21/733–735

[56] References Cited

U.S. PATENT DOCUMENTS

| | | |
|---|---|---|
| 1,222,770 | 4/1917 | Kaye . |
| 1,594,850 | 8/1926 | Perkins . |
| 1,841,062 | 1/1932 | Schavoir . |
| 3,519,271 | 7/1970 | Smith . |
| 3,985,363 | 10/1976 | Jepson . |
| 4,511,147 | 4/1985 | Olsen . |
| 4,927,144 | 5/1990 | Stormon . |
| 5,090,702 | 2/1992 | Viste . |
| 5,332,223 | 7/1994 | Johnson . |
| 5,435,551 | 7/1995 | Chen . |
| 5,447,307 | 9/1995 | Antonious . |
| 5,584,770 | 12/1996 | Jensen . |
| 5,735,755 | 4/1998 | Kobayashi . |

FOREIGN PATENT DOCUMENTS

| | | |
|---|---|---|
| 60-97158 | 2/1985 | Japan . |
| 63-16065 | 2/1988 | Japan . |
| 9-285576 | 4/1997 | Japan . |

*Primary Examiner*—Sebastiano Passaniti
*Attorney, Agent, or Firm*—Quarles & Brady LLP

[57] ABSTRACT

A golf club is provided incorporating a head having an optimum loft angle, and lie angle for respective golfers. Moreover the golf club has minimal head deflection when striking a golf ball, and improved strength. To achieve this, a head attachment portion 13 disposed at a rear face 4A of a face 4, is substantially horizontally connected to a base end 9B of a shaft attachment portion 9. The shaft attachment portion 9 is connected to the face 4 via the head attachment portion 13. The face 4 and the shaft attachment portion 9 connected to the head attachment portion 13 are made separate, and hence at the time of assembling the various combinations, the loft angle and the lie angle can be freely adjusted. The impact force of a golf ball is transmitted directly from the face 4 to the head attachment portion 31, and the transmission force can be transmitted directly to the shaft 3 via the shaft attachment portion 9. Hence the transmission path can be increased so that the possibility of head 2 distortion at the time of striking a ball is minimal.

9 Claims, 16 Drawing Sheets

GOLF CLUB

BACKGROUND OF THE INVENTION

1. Field of the Invention

The present invention relates to golf clubs such as iron clubs, wood clubs, and putter clubs.

2. Description of the Related Art

Golf clubs are made from a shaft and a club head, and are normally classified into three groups, namely a wood, an iron, and a putter. The iron is classified according to the loft angle. A small loft angle (for example 20° to 30°) iron is referred to as a long iron, while a large loft angle (for example 40° to 50°) iron is referred to as a short iron. Normally, irons are numbered from the long iron to the short iron, for example from No. 1 to No. 9, and then there is a PW (pitching wedge), a SW (sand wedge), and a LW (lob wedge).

A conventional iron club head (referred to hereunder as a head) is formed for example as shown in FIG. 1 of Japanese Unexamined Patent Publication No. 9-285576, or FIG. 1 of Japanese Unexamined Utility Model Publication No. 60-97158, with a shaft attachment portion referred to as a hosel, formed integral with one side of a head body formed with a face and sole etc., with the shaft attachment portion formed with a predetermined angle (shaft lie angle).

Furthermore, in FIG. 1 of Japanese Unexamined Utility Model Publication No.63-16065 is disclosed a club wherein the head body provided integral with the shaft attachment portion is made of titanium, and a balance weight of brass is provided on a rear face of the head body.

However, since the heads, as mentioned above are formed integrally, for example by forging, with the shaft attachment portion and have a predetermined angle according to the respective club numbers, it becomes troublesome to manufacture heads incorporating optimum loft angles and lie angles for respective golfers, or to manufacture heads with the sweet area formed at a desired location. Furthermore with the conventional head, there is the problem that since the impact on the face at the time of striking the ball is transmitted to the shaft via the neck and shaft attachment portion (hosel), the transmission path for the impact force is short so that at the time of striking the ball the head is susceptible to deflection.

SUMMARY OF THE INVENTION

Accordingly it is an object of the present invention to provide a golf club incorporating a head having an optimum loft angle, and lie angle for respective golfers.

It is a further object of the invention to provide a golf club with minimal head deflection when striking a golf ball, and which has improved strength at the time of striking the ball.

With the golf club according to a first aspect of the invention, with a shaft attachment portion provided on one side of a face of a head body, and a shaft connected to a tip end of the shaft attachment portion, a head attachment portion extending from a base end of the shaft attachment portion spans approximately from a heel of the head body to a toe, and the shaft attachment portion is connected to the head by means of the head attachment portion. Consequently, with the club according to the first aspect, the head attachment portion is connected to the head, and the shaft is connected to the shaft attachment portion for connecting to the head attachment portion.

With the golf club according to a second aspect of the invention, the head attachment portion is formed from a substantially horizontally oriented rod like member. Therefore with the golf club of the second aspect, the substantially horizontally provided head attachment portion is connected to the approximate center of the head body, and the shaft is connected to the shaft attachment portion for connecting to the head attachment portion.

With the golf club according to a third aspect of the invention, the head attachment portion is formed from a rod like member formed in an approximate loop shape along the edge of the face. Consequently, with the third aspect, the loop shape head attachment portion is connected approximately along the edge of the head body, and the shaft is connected to the shaft attachment portion for connecting to the head attachment portion.

With the golf club according to a fourth aspect of the invention, one end of the head attachment portion is provided close to the heel of the head body, and the other end is provided close to the toe of the head body. Consequently with the fourth aspect, at least the ends of the head attachment portion are respectively connected close to the heel and close to the toe of the head body.

With the golf club according to a fifth aspect of the invention, the integrally formed shaft attachment portion and head attachment portion is formed from a material having a greater density than that of the face. Consequently, the center of gravity of the head can be freely set depending on the attachment position of the attachment portion.

With the golf club of according to a sixth aspect of the invention, the position of the head attachment portion is changed depending on the club number. Consequently, the position of for example the center of gravity can be changed depending on the attachment position of the attachment portion.

DESCRIPTION OF THE PREFERRED EMBODIMENTS

Figure 1:
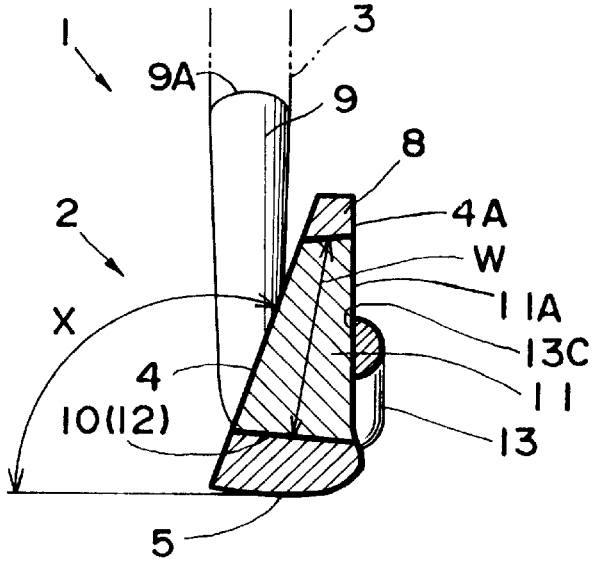
FIG. 1 is a cross-sectional view illustrating a first embodiment of the present invention.
Figure 2:
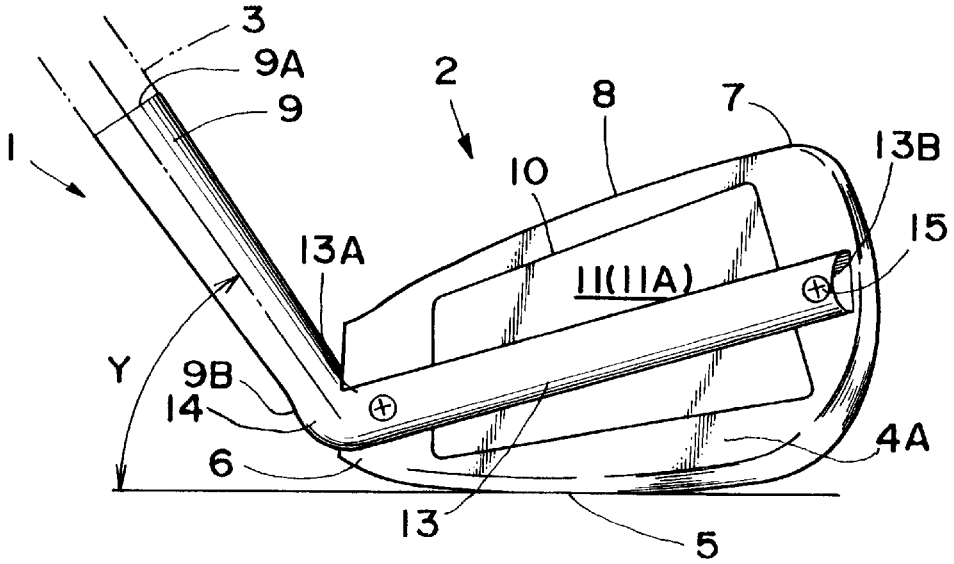
FIG. 2 is a back view of the first embodiment.
Figure 3:
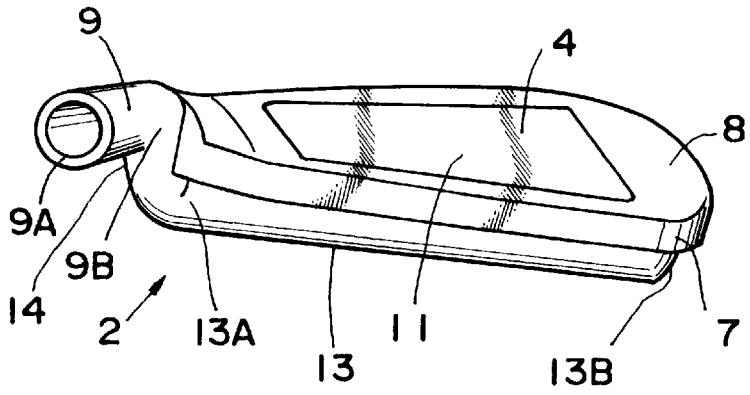
FIG. 3 is a plan view of the first embodiment.
Figure 4:
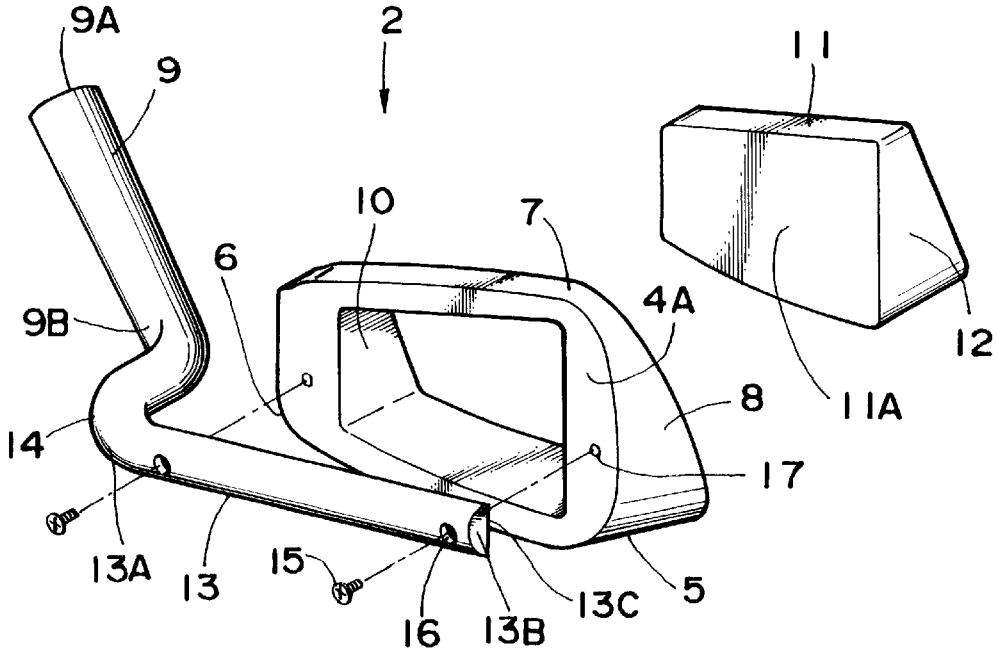
FIG. 4 is an exploded perspective view of the first embodiment.

As follows is a description of a first embodiment of the present invention, with reference to FIG. 1 through FIG. 7. As shown in FIG. 1 through FIG. 4, a golf club 1 comprises a head 2 and a shaft 3 connected to the head 2. Furthermore, the head 2 incorporates; a head body 8 with a head face 4 formed on a front face, a sole 5 formed on a bottom portion, a heel 6 formed on one side and a toe 7 formed on the other side, and a shaft attachment portion 9 referred to as a hosel, provided on one side of the head body 8 as a separate member to the head body 8. The shaft 3 is connected to a tip end 9A of the shaft attachment portion 9. With the head body 8, a window opening 10 corresponding to the face 4 is cut out towards the rear, and a substantially block shaped facing member 11 is secured in the window opening 10. The head body 8 and the facing member 11 are made from different materials. For example the head body 8 is made from a metal material with a high density such as a steel i.e. stainless steel, or copper, or a copper alloy such as beryllium copper alloy. On the other hand, the facing member 11 is made from a metal material having a low density such as titanium (pure), titanium alloy, or aluminium. The facing member 11 is press fitted into the window opening 10. For this, the facing member 11 is formed in a wedge shape with the width W of a peripheral face 12 of the facing member 11 and the window opening 10 increasing from the face 4 side towards the rear side.

A head attachment portion 13 extends approximately transversely from a base end 9B of the shaft attachment portion 9. The head attachment portion 13 is formed from a long thin rod like member aligned transversely in a substantially horizontal direction from a bent portion 14 which extends slightly rearward from the base end 9B. One end 13A is located on the heel 6 side of the rear face 4A of the face 4 while the other end 13B is located on the other side of the rear face 4A. The integrally formed cylindrical shaft attachment portion 9 and head attachment portion 13 are formed for example from a metal material having a low density such as titanium (pure), titanium alloy, or aluminium. A front face 13C of the head attachment portion 13 is formed so as to fit tightly onto the rear face 4A and the rear face 11A of the facing member 11. Moreover, the integrally formed cylindrical shaft attachment portion 9 and head attachment portion 13 may be made of a material such as a steel i.e. stainless steel, or a copper alloy such as beryllium copper alloy with a higher density than that of the material forming the facing member 11. The front face 13C of the head attachment portion 13 abuts against the rear faces 4A, 11A. Moreover the one end 13A of the head attachment portion 13 is fixed to the heel 6 side by a fixing device, and the other end 13B is fixed to the other side of the head body 8 by a fixing device such as a threaded member, i.e. a screw or nut, and/or by welding. With this embodiment, a screw 15 is used as the fixing device, the screw 15 passing through a hole 16 formed in the head attachment portion 13, and threading into a threaded hole 17 in the rear face 4A. At this time the golf club 1 is made up with the head attachment portion 13 fixed to the head body 8 with the loft angle of the face 4 on the head body 8 set to X, and the lie angle of the shaft attachment portion 9 set to Y, and with the lower end of the shaft 3 connected to the shaft attachment portion 9.

Figure 5:
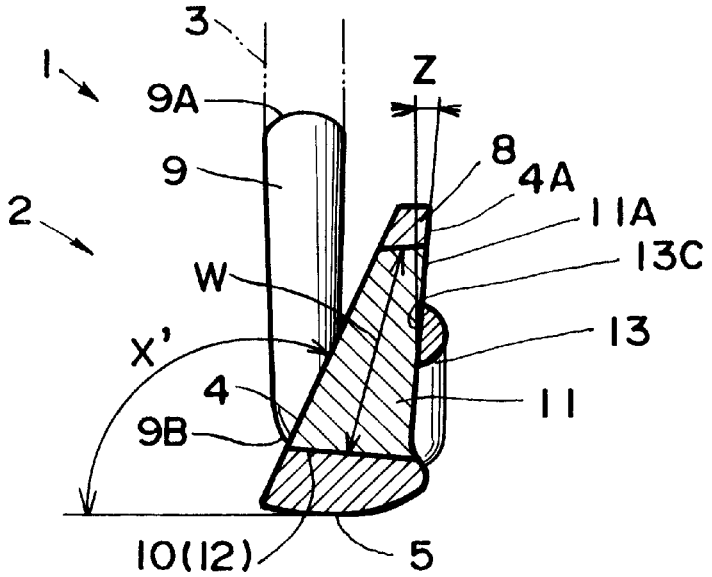
FIG. 5 is a cross-sectional view of the first embodiment, with the loft angle in a different condition.
Figure 6:
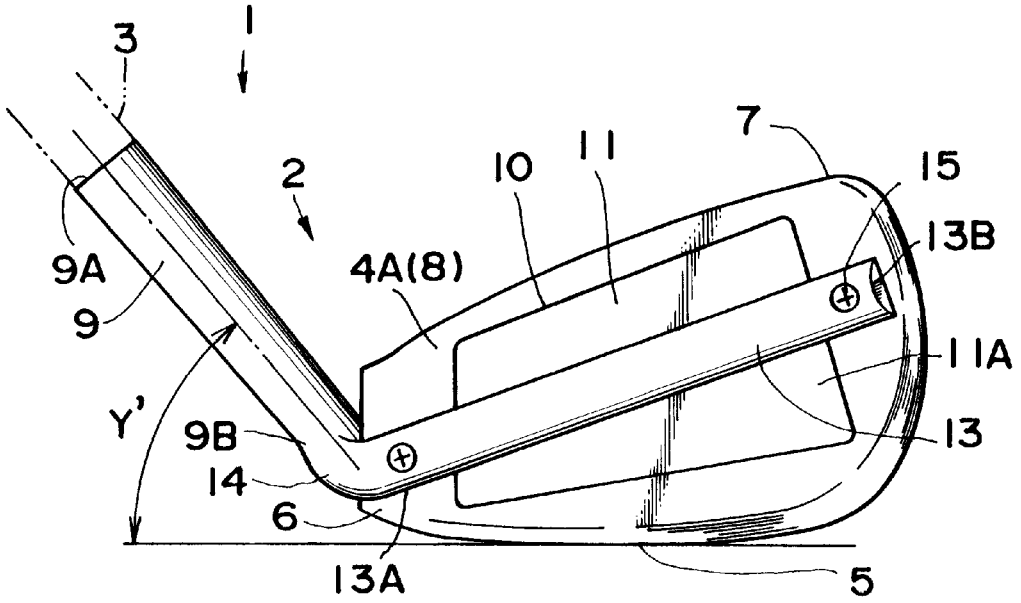
FIG. 6 is a back view of the first embodiment, with the lie angle in a different condition.
Figure 7:
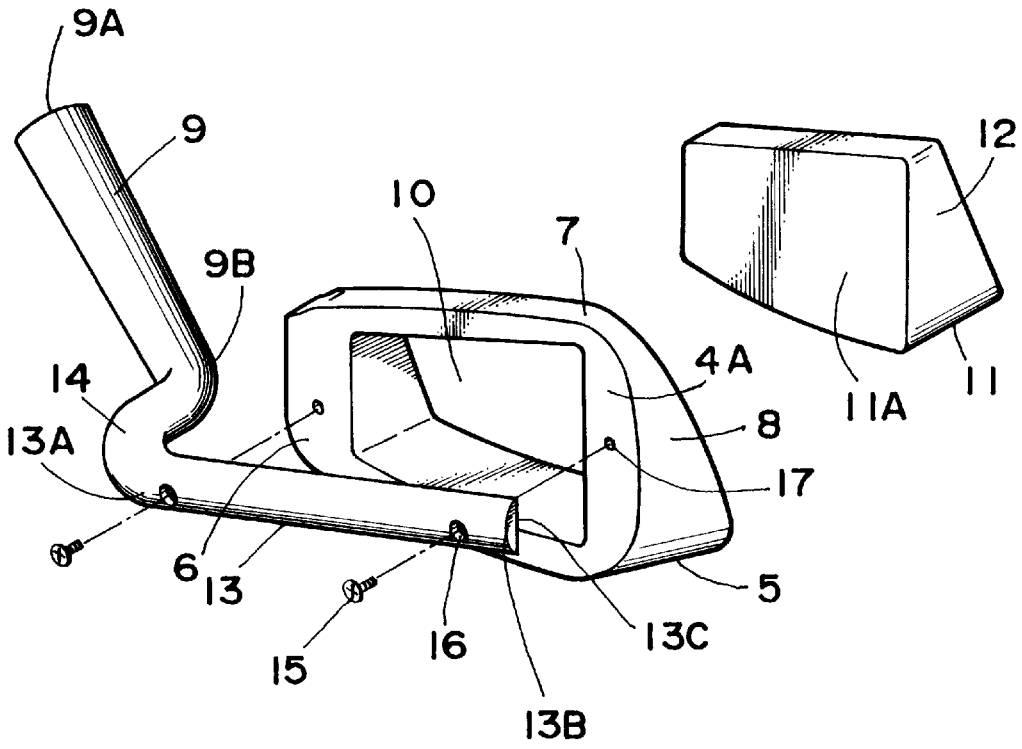
FIG. 7 is an exploded perspective view of the first embodiment, with the lie angle in a different condition.

Consequently, for example as shown in FIG. 5 through FIG. 7, when the lie angle Y' of the shaft attachment portion 9 is to be made smaller than the lie angle Y, the attachment position of the other end 13B of the head, attachment portion 13 to the head body 8, is fixed at a position slightly higher than in FIG. 1, so that a small lie angle Y can be produced. Furthermore, in the case where a loft angle X' which is greater than the loft angle X of FIG. 1 is to be produced, then the front face 13C of the head attachment portion 13 can be preformed with a predetermined inclie angle Z so as to form the loft angle X', and the head attachment portion 13 then secured against the rear faces 4A, 11A. With the case shown in FIG. 5 through FIG. 7, the head attachment portion 13 is located slightly further upward on the head body than with the arrangement shown in FIG. 1 through FIG. 4, and hence the center of gravity position (not shown) of the head 2 is slightly higher.

In the above manner, the position of the head attachment portion 13 corresponding to the club number can be changed, and the position of the center of gravity can be altered.

With the first embodiment as described above, with a golf club with the shaft attachment portion 9 provided on one side of the face 4 and the shaft 3 connected to the shaft attachment portion 9, the head attachment portion 13 extending from the base end 9B of the shaft attachment portion 9 spans approximately from the heel 6 of the head 2 (head body 8) to the toe 7. To explain in detail, the head attachment portion 13 located on the rear faces 4A, 11A of the face 4 is connected spanning approximately transversely from the heel 6 of the head 2 (head body 8) to the toe 7, and the shaft attachment portion 9 is connected to the head body 8 by means of the head attachment portion 13. That is to say, with the head 2, the head body 8 formed by the face 4, the sole 5, the heel 6 and the toe 7 etc., and the shaft attachment portion 9 with the head attachment portion 13 connected to the base end 9B, for connecting to the shaft 3, are provided separately. Furthermore, by making up variously shaped head bodies 8, and head attachment portions 13 integrally formed with the shaft attachment portion 9, then at the time of assembling the various combinations, the lie angles Y, Y' and the loft angles X X' can be easily adjusted. Moreover, the impact on the face 4 at the time of striking a ball is not transmitted to the shaft via the neck and the shaft attachment portion (hosel) as with the conventional head, but is transmitted directly from the face 4 to the head attachment portion 13, and the transmission force can be transmitted directly to the shaft 3 via the shaft attachment portion 9. That is to say, the transmission path can be increased so that the possibility of head 2 distortion at the time of striking a ball is minimal. Furthermore, since the attachment position, for example the attachment height, for the head attachment portion 13 can be freely adjusted relative to the rear faces 4A, 11A, then the center of gravity position of the head 2, and the sweet area can also be adjusted.

Moreover, by forming the head attachment portion 13 from a substantially horizontal rod like member, then the inertial moment of the head 2 can be reduced, and deflection of the head 2 when hitting a ball can be further reduced. In particular, by locating the head attachment portion 13 in the vicinity of the center of gravity position of the head 2, then the inertial moment can be further reduced.

Furthermore, by providing the one end 13A of the head attachment portion 13 close to the heel 6 of the head body 8, and providing the other end 13B close to the toe 7 of the head body, that is to say, by fixing the one end 13A at one end of the head body 8, and fixing the other end 13B at the other end of the head body 8, then both end points of the head attachment portion 13 are fixed to the rear faces 4A, 11A, thereby ensuring a maximum moment. Consequently, the strength at the time of striking a ball can be increased.

Furthermore, by forming the integrally formed shaft attachment portion 9 and head attachment portion 13 from a material having a greater density than that of the facing member 11, then the center of gravity of the head 2 can be located as far as possible to the rear. As a result, the sweet area can be increased. Furthermore, since the head attachment portion 13 can be easily attached to the face 4 at any suitable location, then the weight distribution can be freely set.

Moreover, by making the shaft attachment portion 9 and the head attachment portion 13 from a material having a lower density than that of the head body 8, then the weight distribution in the weighting of the head 2, due to the shaft attachment portion 9 and the head attachment portion 13 can be reduced. As a result, the degree of freedom of weight distribution in the head 2 can be improved. Moreover, by forming the window opening 10 corresponding to the face 4 in the head body 8, and securing the facing member 11 made from a material of a lower density than that of the head body 8 in the window opening 10, then a greater weight can be distributed at the periphery of the head body 8 and hence the head 2, so that the degree of freedom of weight distribution for an equivalent head 2 can be further improved.

Furthermore, the location of the head attachment portion 13 can be changed corresponding to the golf club number, enabling the completion of an iron golf club set where the position of the center of gravity etc. can be easily changed.

Next is a description of a second and third embodiment of the present invention. Parts corresponding to those of the first embodiment are denoted by the same symbols and description is omitted.

Figure 8:
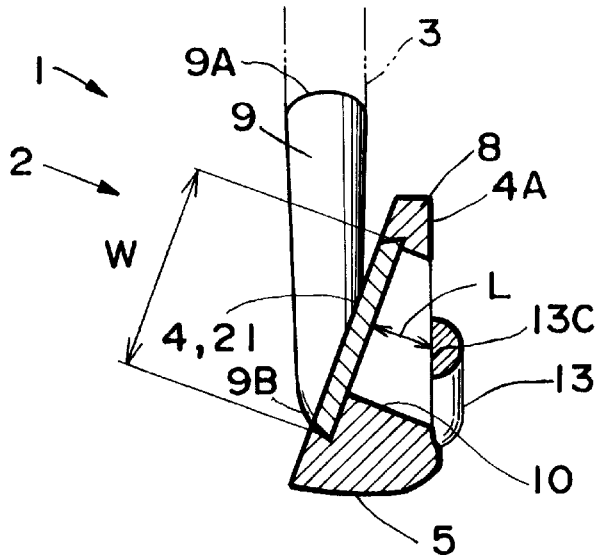
FIG. 8 is a cross-sectional view illustrating a second embodiment of the present invention.
Figure 9:
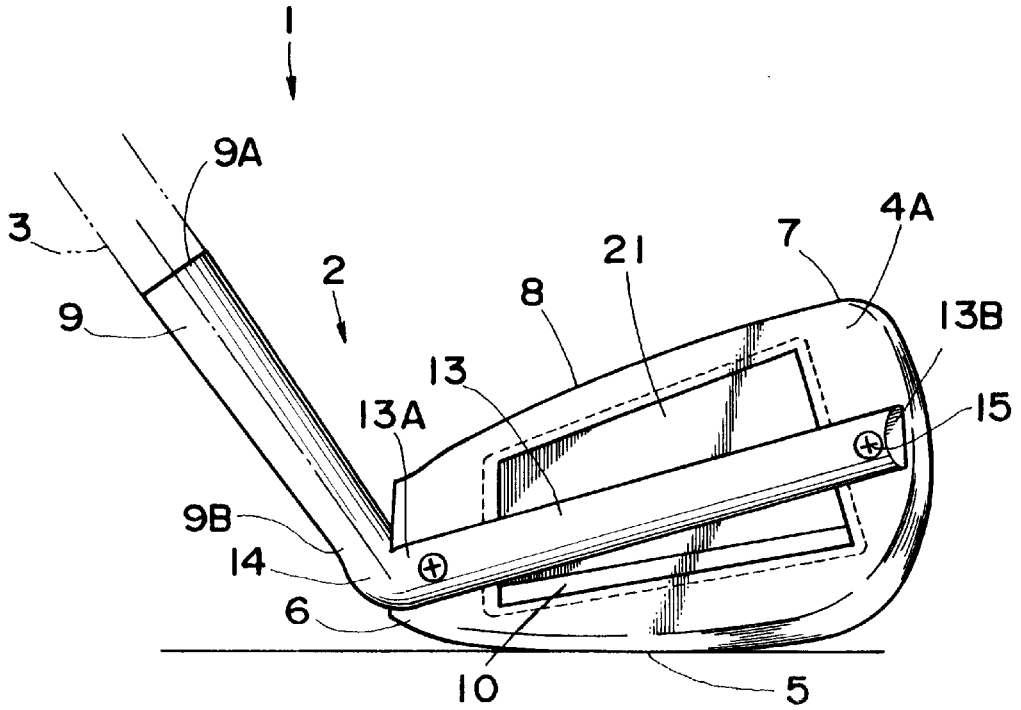
FIG. 9 is a back view of the second embodiment.
Figure 10:
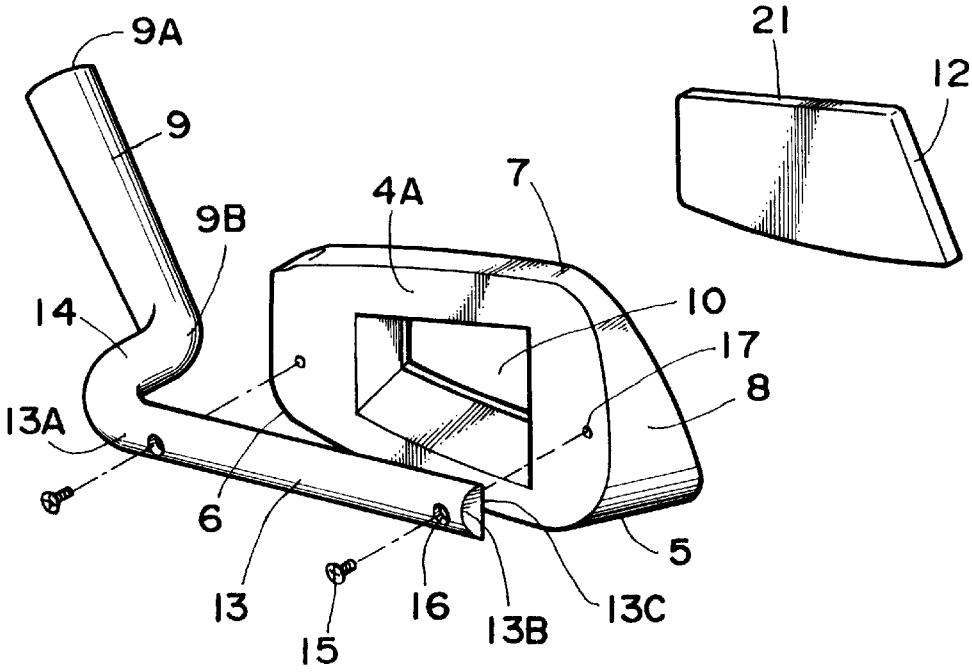
FIG. 10 is an exploded perspective view of the second embodiment.

With the second embodiment shown in FIG. 8 through FIG. 10, a planar face member 21 is arranged on the face 4 side only of the window opening 10 of the head body 8. Furthermore, the head attachment portion 13 is attached by fixing means such as a screw 15 and/or welding so as to only abut against the rear face 4A. At this time the central portion of the head attachment portion 13 corresponding to the window opening 10 is positioned so as to span from the heel 6 side to the toe 7 side.

Consequently, with the second embodiment, in addition to the operational effect of the first embodiment, since the planar face member 21 is disposed in the window opening 10, a gap L is formed between the face member 21 and the head attachment portion 13. Hence the amount of deformation of the face member 21 at the time of striking a ball can be increased, and thus springiness can be improved.

Figure 11:
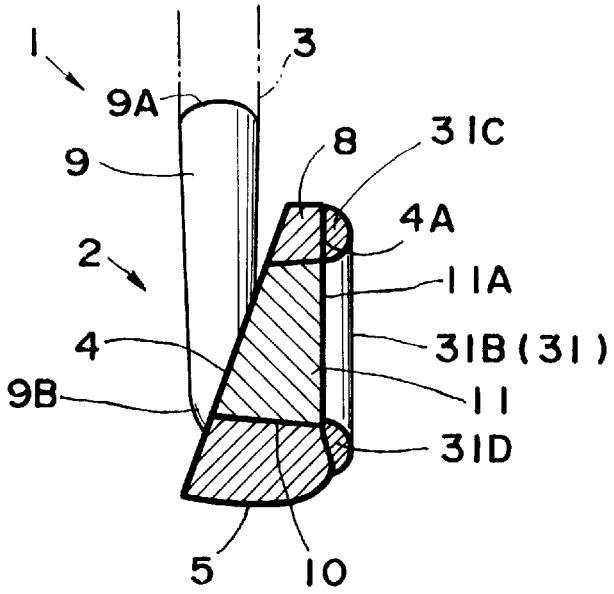
FIG. 11 is a cross-sectional view illustrating a third embodiment of the present invention.
Figure 12:
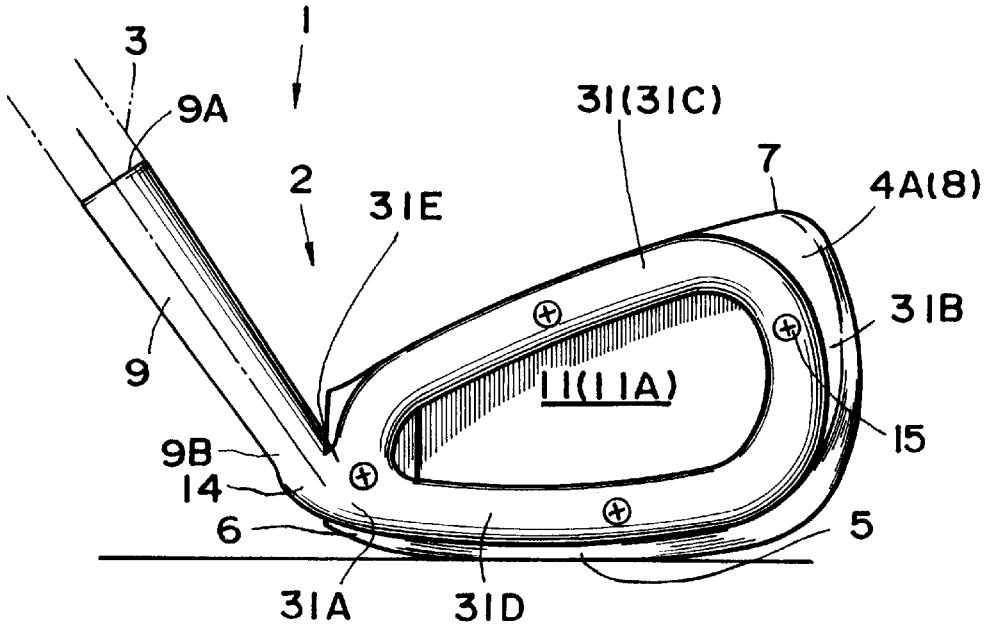
FIG. 12 is a back view of the third embodiment.
Figure 13:
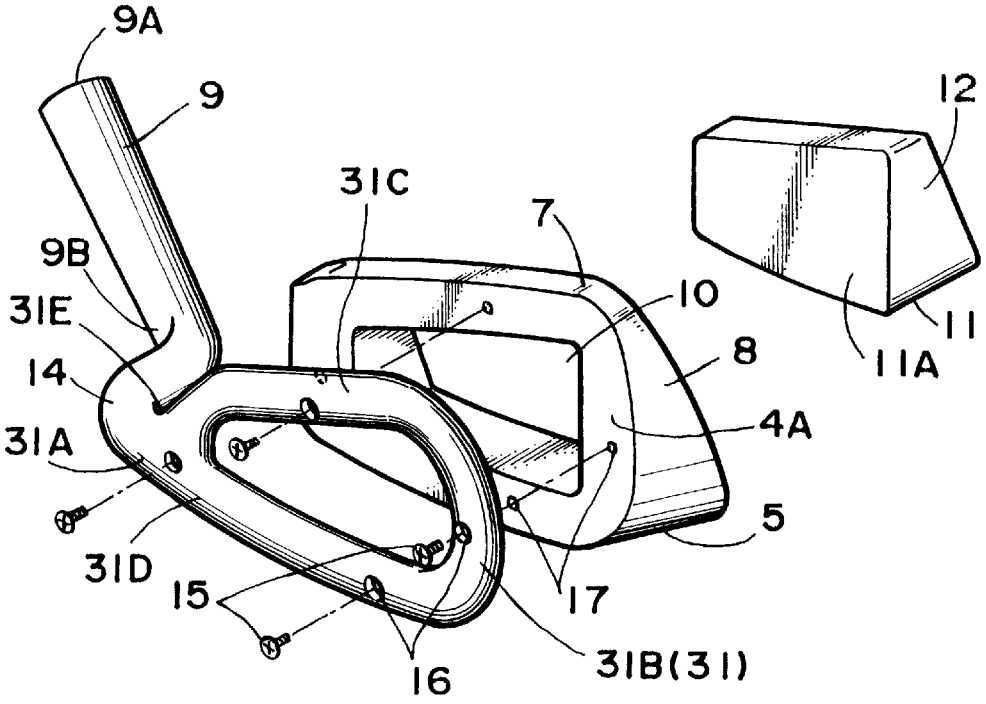
FIG. 13 is an exploded perspective view of the third embodiment.

With the third embodiment shown in FIG. 11 through FIG. 13, an end 31E of the head attachment portion 31 which connects to the shaft attachment portion 9, is connected to the one end 31A so as to give a loop shape. Furthermore, the head attachment portion 31 is formed in a substantially transverse direction so that the rod like member follows approximately around the outer edge of the rear face 4A of the face 4. The four sides are fixed to the head body 8 by means of screws 15. That is to say, the one end 31A is fixed to the heel 6 side of the rear face 4A, the other end 31B is fixed to the toe 7 side, while the upper and lower portions 31C, 31D are fixed to the upper and lower portions of the rear face 4A by means of screws 15. The end 31E may be contactingly connected to the one end 31A, or may be provided in the vicinity of the one end 31A. Preferably however this is connected to the one end 31A.

Consequently, with the third embodiment, as with the first embodiment, the head body 8 and the shaft attachment portion 9 with the head attachment portion 31 connected to the base end 9B, for connecting to the shaft 3, are provided separately. Furthermore, by making up variously shaped head bodies 8, and head attachment portions 13 integrally formed with the shaft attachment portion 9, then at the time of assembling the various combinations, the lie angle Y and the loft angle X can be easily adjusted. Moreover, the impact force of a golf ball is transmitted directly from the face 4 to the head attachment portion 31, and the transmission force can be transmitted directly to the shaft 3 via the shaft attachment portion 9. Hence the possibility of head 2 distortion at the time of striking a ball is minimal. Furthermore, since the attachment position of the head attachment portion 31 can be freely adjusted relative to the rear face 4A, then the center of gravity position of the head 2, and the sweet area can also be adjusted.

Furthermore, by providing the one end 13A of the head attachment portion 13 close to the heel 6 of the head body 8, and providing the other end 13B close to the toe 7 of the head body, then both end points of the head attachment portion 31 are fixed to the rear faces 4A, 11A, thereby ensuring a maximum moment. Consequently, the strength at the time of striking a ball can be increased. Furthermore, by forming the head attachment portion 31 in a loop following around the outer edge of the rear face 4A of the head body 8, then the impact at the time of striking a golf ball can be distributed and hence the strength improved. Moreover, since the impact force is transmitted to the loop shape attachment portion 31, an enlargement of the transmission path is possible.

Figure 14:
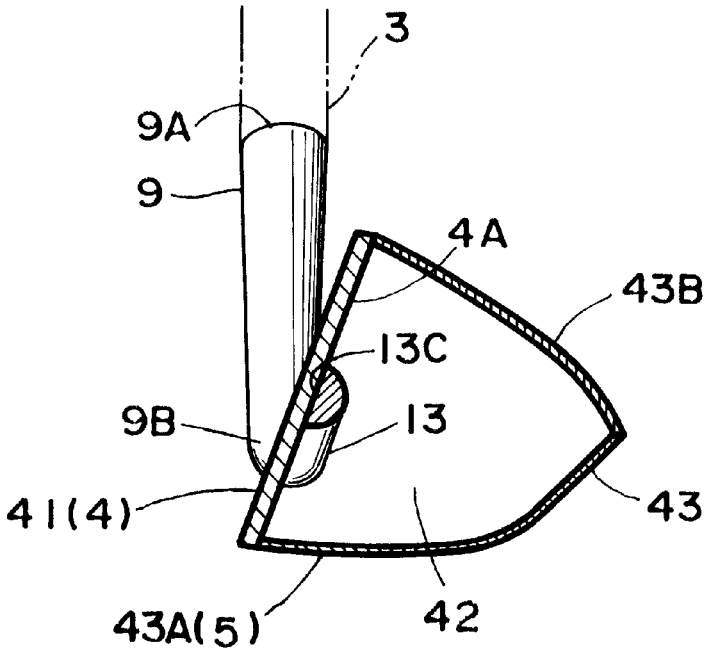
FIG. 14 is a cross-sectional view illustrating a fourth embodiment of the present invention.
Figure 15:
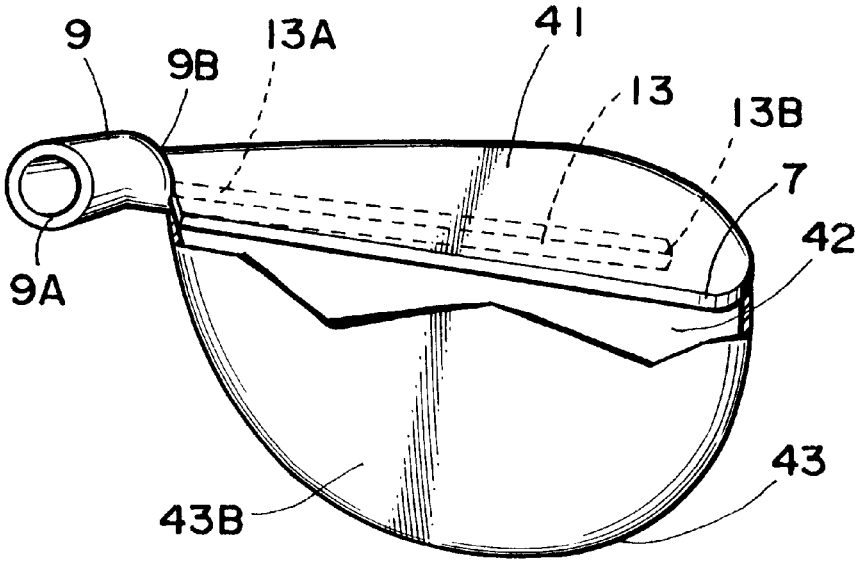
FIG. 15 is a partially cut away plan view of the fourth embodiment.
Figure 16:
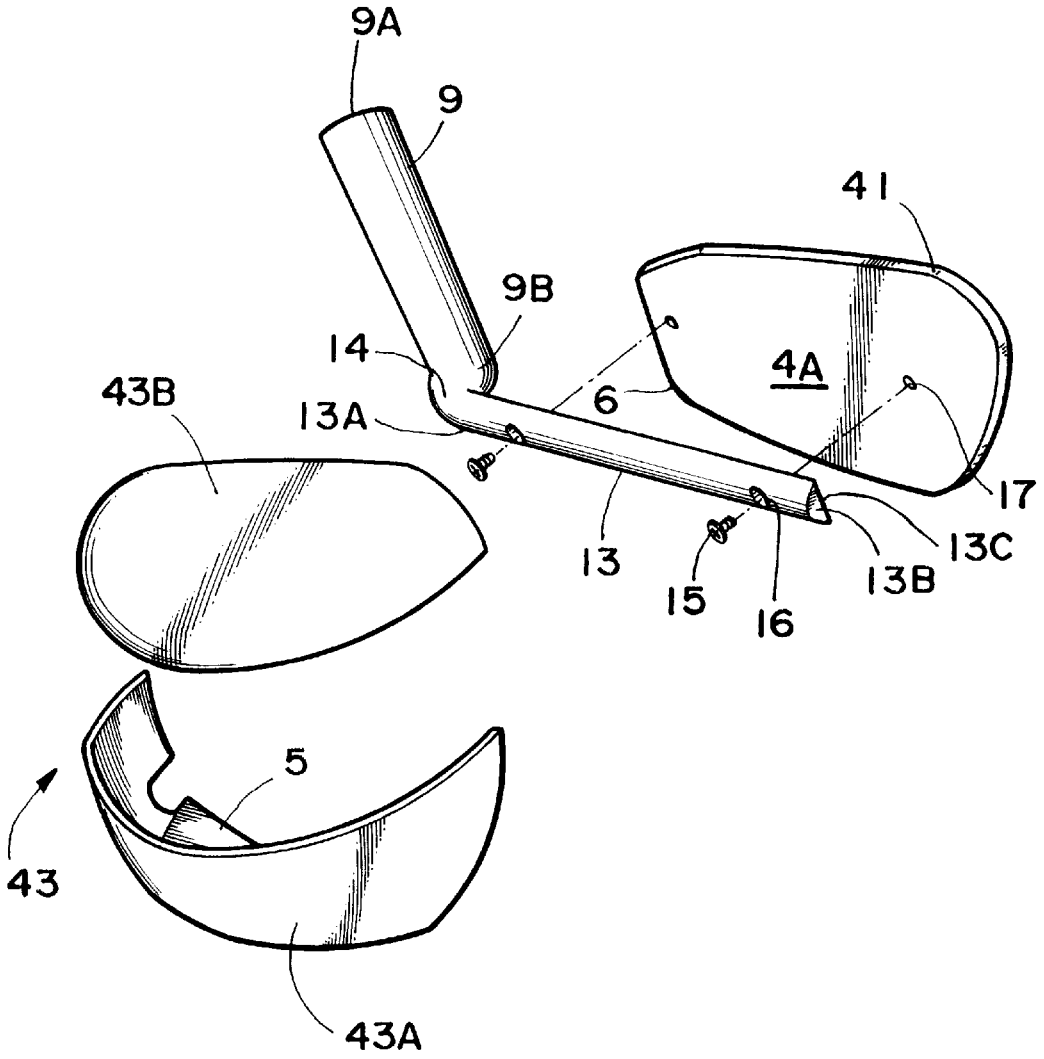
FIG. 16 is an exploded perspective view of the fourth embodiment.

Next is a description of a fourth and fifth embodiment. The fourth embodiment shown in FIG. 14 through FIG. 16 is illustrated as one with a hollow type head 41. This is one where a rear shell 43 is provided on a rear portion of the face 4 by way of a hollow region 42. The rear shell 43 may be integrally formed, however as shown in FIG. 16, this may be made up of several parts such as a sole and side peripheral shell 43A, and a top shell 43B joined together as one. Moreover, the hollow region 42 may be filled with a foam material (not shown in the figure). The head attachment portion 13 connected to the shaft attachment portion 9 as with the first embodiment, is fixed to the rear face 4A of the face 4.

Consequently, with the fourth embodiment, as with the first embodiment, the face 4 and the shaft attachment portion 9 with the head attachment portion 13 connected to the base end 9B, for connecting to the shaft 3, are provided separately. Furthermore, by making up variously shaped faces 4, and head attachment portions 13 integrally formed with the shaft attachment portion 9, then at the time of assembling the various combinations, the lie angle and the loft angle can be easily adjusted. Moreover, the impact force of a golf ball is transmitted directly from the face 4 to the head attachment portion 13, and the transmission force can be transmitted directly to the shaft 3 via the shaft attachment portion 9. Hence the possibility of head 2 distortion at the time of striking a ball is minimal. Furthermore, since the attachment position of the head attachment portion 13 can be freely adjusted relative to the rear face 4A, then the center of gravity position of the head 2, and the sweet area can also be adjusted.

Moreover, by providing the one end 13A of the head attachment portion 13 close to the heel 6 of the face 4, and providing the other end 13B close to the toe 7 of the head body, then both end points of the head attachment portion 13 are fixed to the rear face 4A, thereby ensuring a maximum moment. Consequently, the strength at the time of striking a ball can be increased.

Furthermore, by providing the rear shell 43 rearwards of the face 4, then the center of gravity of the head 40 is moved rearwards, and hence the distance between the face 4 and the center of gravity, that is to say the center of gravity depth is increased, enabling enlargement of the sweet area.

Figure 17:
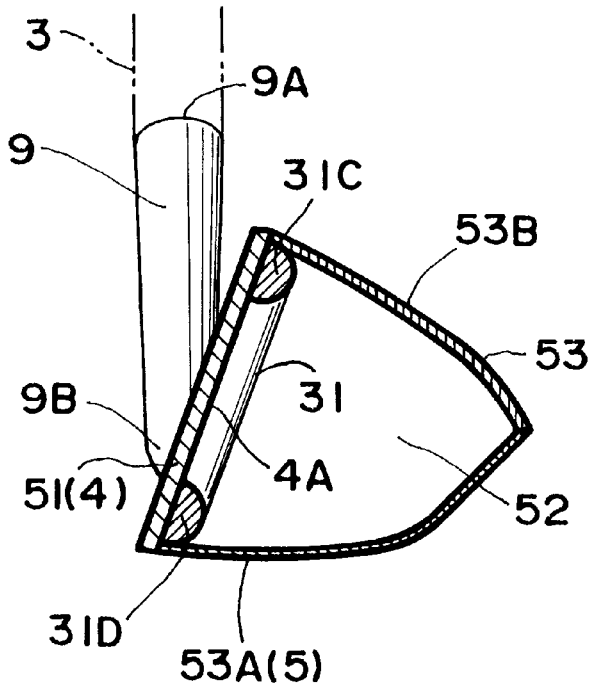
FIG. 17 is a cross-sectional view illustrating a fifth embodiment of the present invention.
Figure 18:
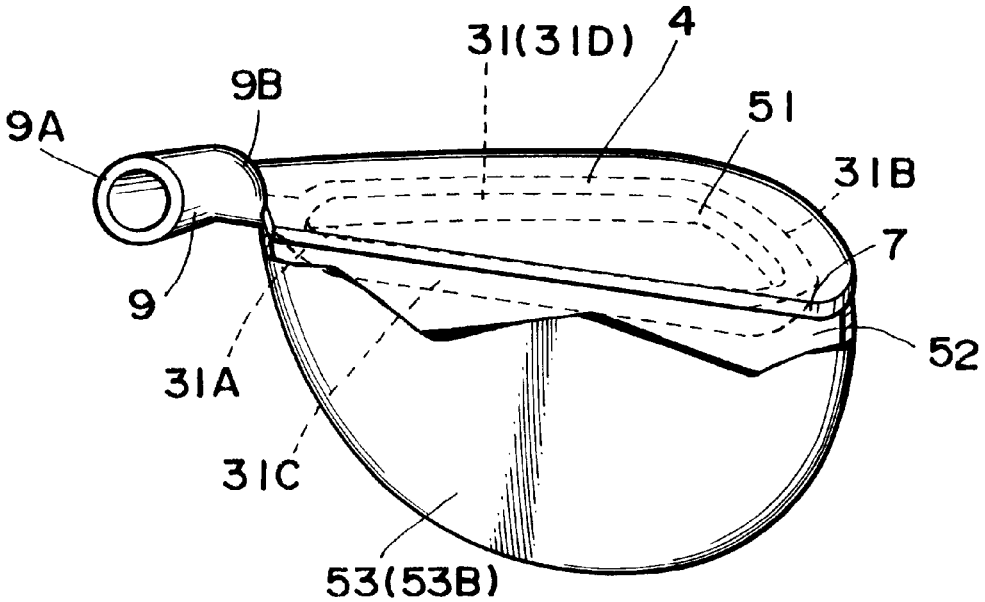
FIG. 18 is a partially cut away plan view of the fifth embodiment.
Figure 19:
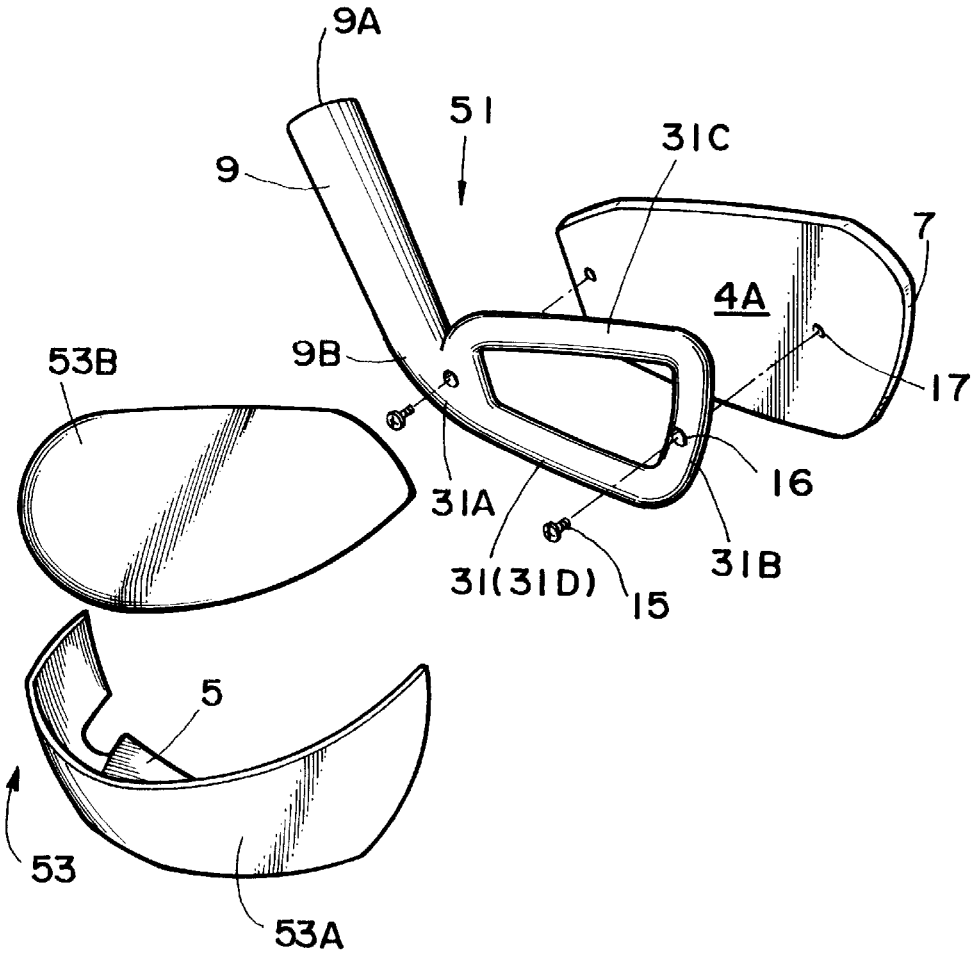
FIG. 19 is an exploded perspective view of the fifth embodiment.

The fifth embodiment shown in FIG. 17 through FIG. 19 is illustrated as one with a hollow type head 51. This is one where a rear shell 53 is provided on a rear portion of the face 4 by way of a hollow region 52. The rear shell 53 may be integrally formed, however as shown in FIG. 19, this may be made up of several parts such as a sole and side peripheral shell 53A, and a top shell 53B joined together as one. Moreover, the hollow region 52 may be filled with a foam material (not shown in the figure). The head attachment portion 31 connected to the shaft attachment portion 9 as with the third embodiment, is fixed to the rear face 4A of the face 4.

Consequently, with the fifth embodiment, as with the third embodiment, the face 4 and the shaft attachment portion 9 with the head attachment portion 31 connected to the base end 9B, for connecting to the shaft 3, are provided separately. Furthermore, by making up variously shaped head bodies 8, and head attachment portions 31 integrally formed with the shaft attachment portion 9, then at the time of assembling the various combinations, the lie angle and the loft angle can be easily adjusted. Moreover, the impact force of a golf ball is transmitted directly from the face 4 to the head attachment portion 31, and the transmission force can be transmitted directly to the shaft 3 via the shaft attachment portion 9. Hence the possibility of head 2 distortion at the time of striking a ball is minimal. Furthermore, since the attachment position of the head attachment portion 31 can be freely adjusted relative to the rear face 4A, then the center of gravity position of the head 2, and the sweet area can also be adjusted.

Moreover, by providing the one end 31A of the head attachment portion 31 close to the heel 6 of the head body 8, and providing the other end 31B close to the toe 7 of the head body, then both end points of the head attachment portion 31 are fixed to the rear face 4A, thereby ensuring a maximum moment. Consequently, the strength at the time of striking a ball can be increased.

Furthermore, by providing the rear shell 53 rearwards of the face 4, then the center of gravity of the head 50 is moved rearwards, and hence the distance between the face 4 and the center of gravity, that is to say the center of gravity depth is increased, enabling enlargement of the sweet area.

Figure 20:
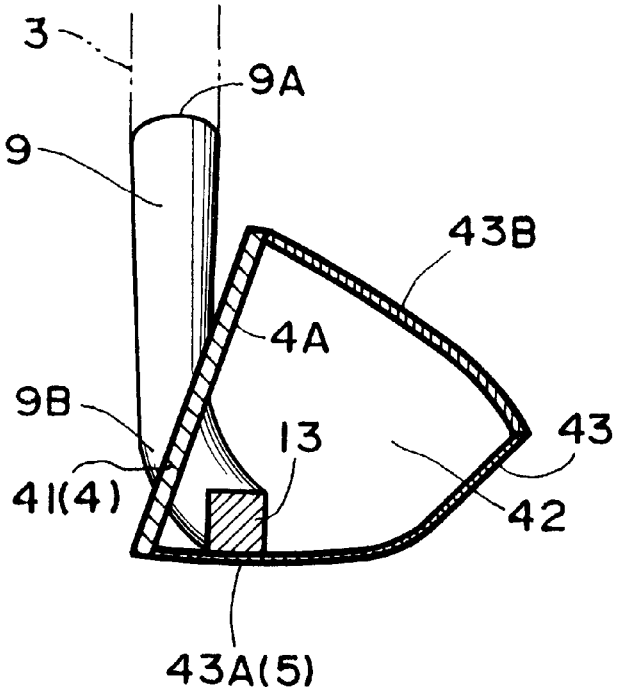
FIG. 20 is a cross-sectional view illustrating a sixth embodiment of the present invention.
Figure 21:
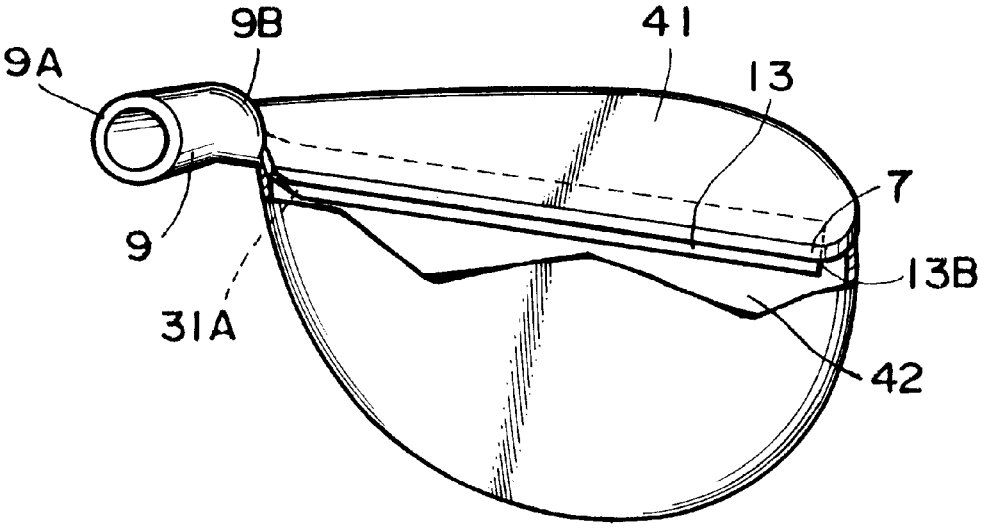
FIG. 21 is a partially cut away plan view of the sixth embodiment.
Figure 22:
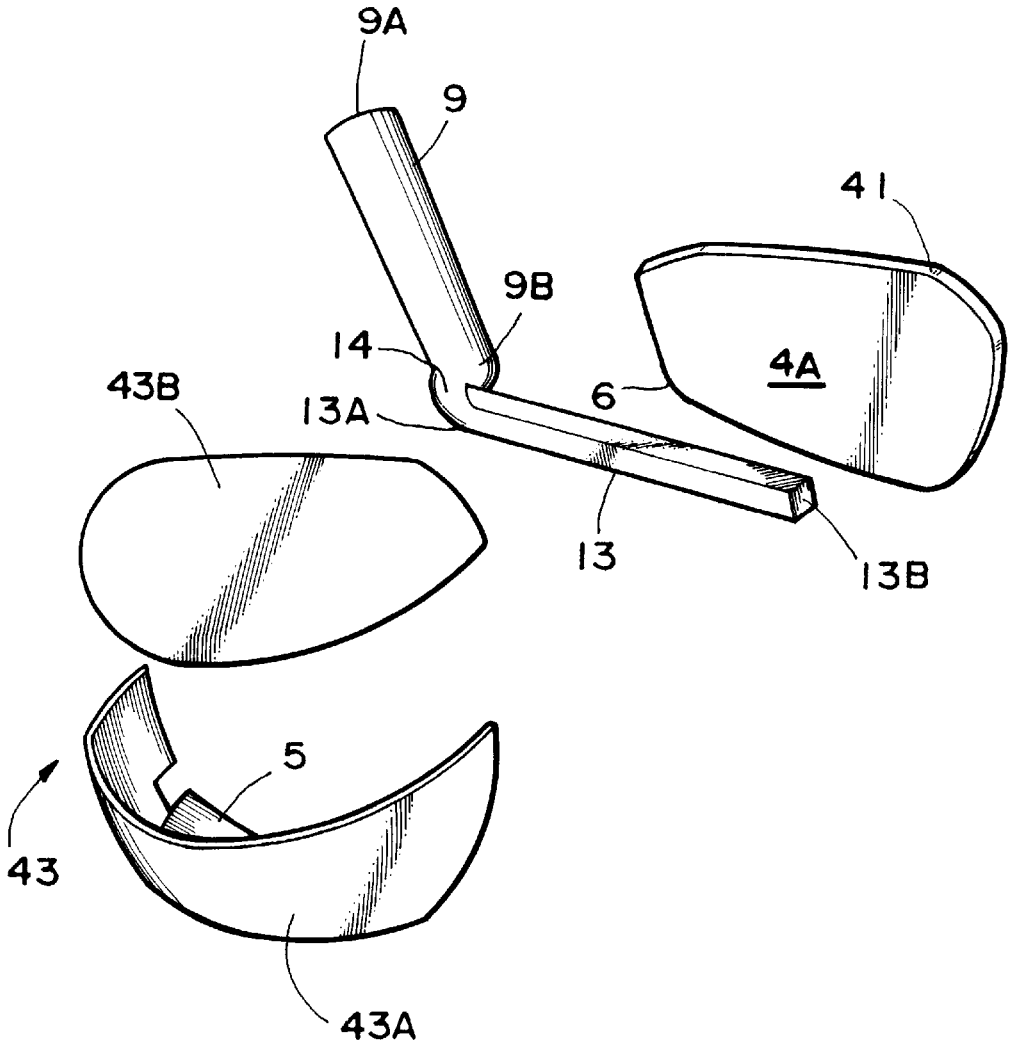
FIG. 22 is an exploded perspective view of the sixth embodiment.

Next is a description of a sixth and seventh embodiment. The sixth embodiment shown in FIG. 20 through FIG. 22 is illustrated as one with a hollow type head 41. This is one where a rear shell 43 is provided on a rear portion of the face 4 by way of a hollow region 42. The rear shell 43 may be integrally formed, however as shown in FIG. 22, this may be made up of several parts such as a sole and side peripheral shell 43A, and a top shell 43B joined together as one. Moreover, the hollow region 42 may be filled with a foam material (not shown in the figure). The head attachment portion 13 of rectangular shape in cross-section and connected to the shaft attachment portion 9 as with the first embodiment, is fixed to the upper face of the sole 5.

Consequently, with the sixth embodiment, as with the first embodiment, the face 4 and the shaft attachment portion 9 with the head attachment portion 13 connected to the base end 9B, for connecting to the shaft 3, are provided separately. Furthermore, by making up variously shaped faces 4, and head attachment portions 13 integrally formed with the shaft attachment portion 9, then at the time of assembling the various combinations, the lie angle and the loft angle can be easily adjusted. Moreover, by connecting the head attachment portion 13 directly to the sole 5 by a suitable means such as welding, then the center of gravity of the head 2 can be lowered. Furthermore, since the attachment position of the head attachment portion 13 can be freely adjusted relative to the sole 5, then the center of gravity position of the head 2, and the sweet area can also be adjusted.

Moreover, by providing the one end 13A of the head attachment portion 13 close to the heel 6, and providing the other end 13B close to the toe 7 of the head body, then both end points of the head attachment portion 13 are fixed to the sole 5, thereby ensuring a maximum moment. Consequently, the strength at the time of striking a ball can be increased.

Furthermore, by providing the rear shell 43 rearwards of the face 4, then the center of gravity of the head 40 is moved rearwards, and hence the distance between the face 4 and the center of gravity, that is to say the center of gravity depth is increased, enabling enlargement of the sweet area.

Figure 23:
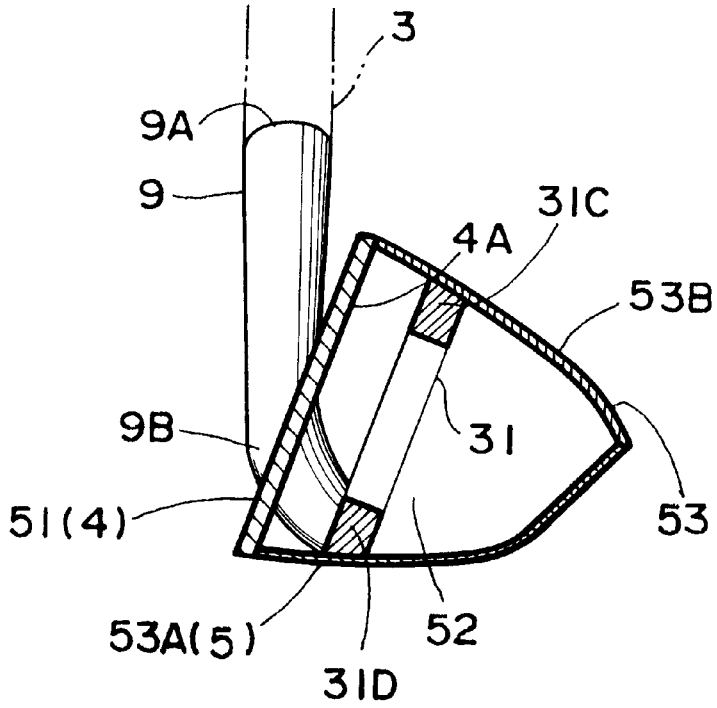
FIG. 23 is a cross-sectional view illustrating a seventh embodiment of the present invention.
Figure 24:
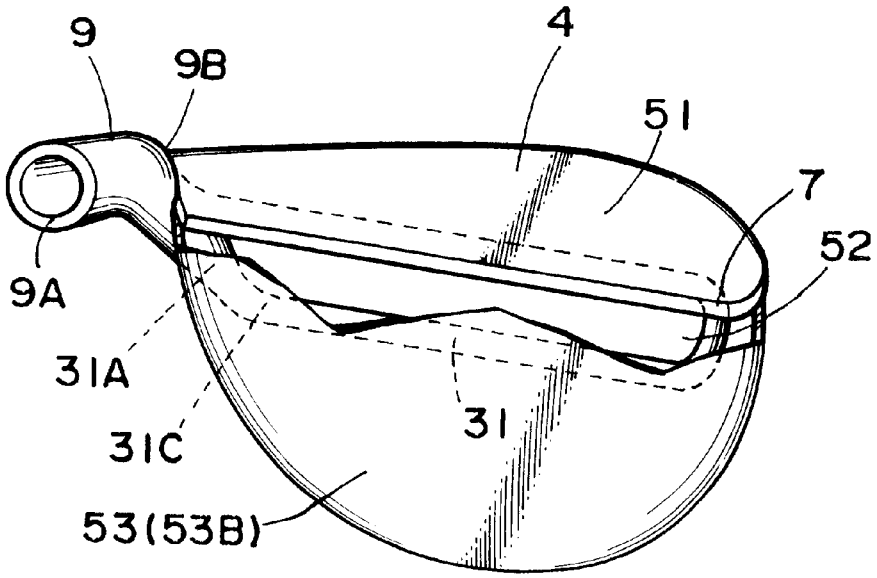
FIG. 24 is a partially cut away plan view of the seventh embodiment.
Figure 25:
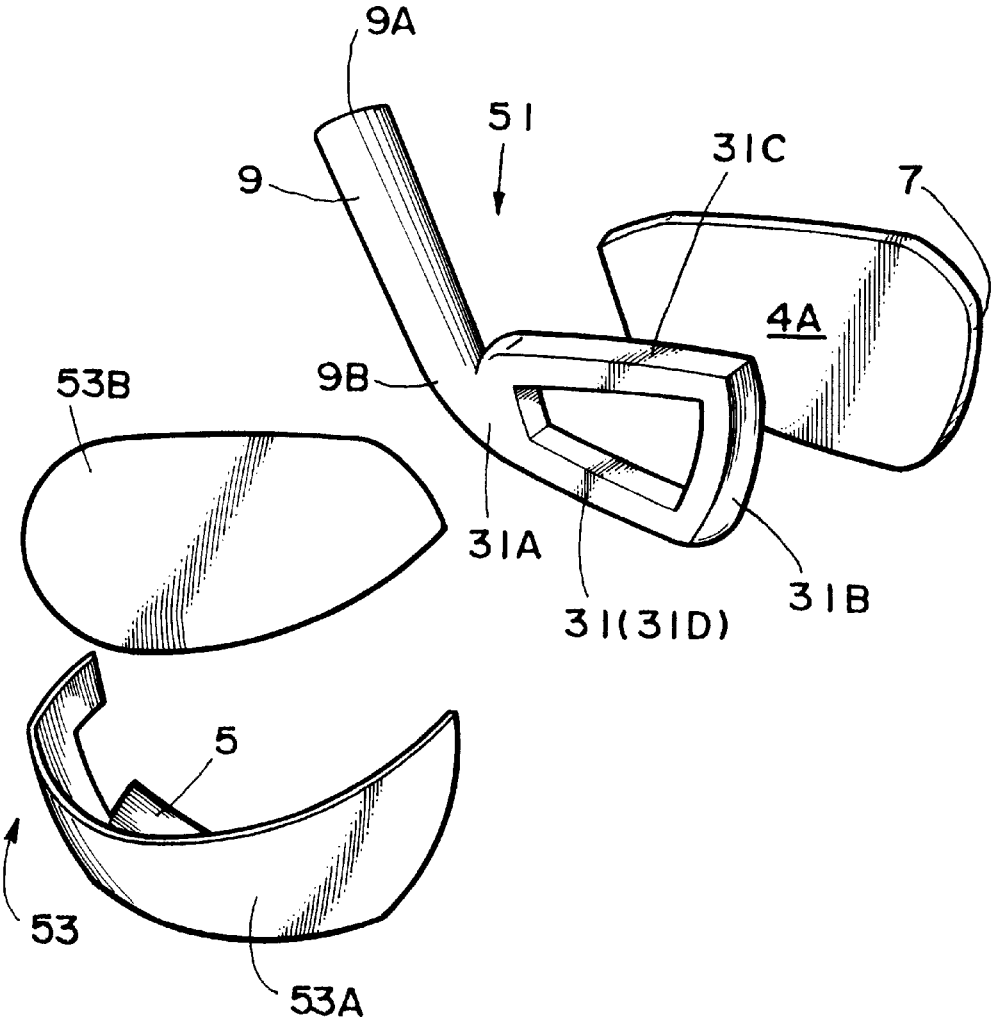
FIG. 25 is an exploded perspective view of the seventh embodiment.

The seventh embodiment shown in FIG. 23 through FIG. 25 is illustrated as one with a hollow type head 51. This is one where a rear shell 53 is provided on a rear portion of the face 4 by way of a hollow region 52. The rear shell 53 may be integrally formed, however as shown in FIG. 25, this may be made up of several parts such as a sole and side peripheral shell 53A, and a top shell 53B joined together as one. Moreover, the hollow region 52 may be filled with a foam material (not shown in the figure). The head attachment portion 31 of quadrilateral shape in cross-section and connected to the shaft attachment portion 9 as with the first embodiment, is fixed to the inner peripheral face of the rear shell 53, by a suitable means such as welding.

Consequently, with the seventh embodiment, as with the third embodiment, the face 4 and the shaft attachment portion 9 with the head attachment portion 31 connected to the base end 9B, for connecting to the shaft 3, are provided separately. Furthermore, by making up variously shaped head bodies 8, and head attachment portions 31 integrally formed with the shaft attachment portion 9, then at the time of assembling the various combinations, the lie angle and the loft angle can be easily adjusted. Furthermore, since the attachment position of the head attachment portion 31 can be freely adjusted relative to the rear shell 53, then the center of gravity position of the head 2, and the sweet area can also be adjusted.

Moreover, by providing the one end 31A of the head attachment portion 31 close to the heel 6 of the head body 8, and providing the other end 31B close to the toe 7 of the head body, then both end points of the head attachment portion 31 are fixed, thereby ensuring a maximum moment. Consequently, the strength at the time of striking a ball can be increased. Moreover, by providing the rear shell 53 rearwards of the face 4, then the center of gravity of the head 51 is moved rearwards, and hence the distance between the face 4 and the center of gravity, that is to say the center of gravity depth is increased, enabling enlargement of the sweet area.

The present invention is not limited to the above mentioned embodiments. For example the means for connecting the head attachment portion to the head body may involve welding, or deformation processing instead of screws, so that at least one end of the head attachment portion is provided close to the heel of the head body, and the other end is provided close to the toe of the head body. Consequently, the whole of the head attachment portion may be connected to the head body, and various other modifications are possible.

With the golf club according to the first aspect of the invention, with a shaft attachment portion provided on one side of a face of a head body, and a shaft connected to a tip end of the shaft attachment portion, a head attachment portion extending from a base end of the shaft attachment portion spans approximately from a heel of the head body to a toe, and the shaft attachment portion is connected to the head by means of the head attachment portion. By eliminating the conventional head body and integrally formed hosel, and connecting the shaft attachment portion and integral head attachment portion to the head body, then the loft angle and lie angle of the head can be easily adjusted. Furthermore, the transmission distance to the shaft, of the impact force at the time of hitting a golf ball can be increased so that deflection of the head can be reduced.

With the golf club according to the second aspect of the invention, the head attachment portion is formed from a substantially horizontally oriented rod like member. Hence the inertial moment due to the head attachment portion can be reduced, so that deflection of the head 2 at the time of striking the ball can be further reduced.

With the golf club according to the third aspect of the invention, the head attachment portion is formed from a rod like member formed in an approximate loop shape along an edge of the face. Hence, the transmission distance to the shaft, of the impact force at the time of hitting a golf ball can be further increased so that deflection of the head can be further reduced, and the strength thus improved.

With the golf club according to the fourth aspect of the invention, one end of the head attachment portion is provided close to the heel of the head body, and the other end is provided close to the toe of the head body. Hence the moment opposing the impact force at the time of hitting a golf ball can be made as large as possible, thereby improving the strength.

With the golf club according to the fifth aspect of the invention, the integrally formed shaft attachment portion and head attachment portion is formed from a material having a greater density than that of the face. Hence the head attachment portion can be weighted, and the position changed depending on the golf club number, so that the center of gravity can be freely changed.

With the golf club according to the sixth aspect of the invention, the position of the head attachment portion is changed depending on the club number. Hence the center of gravity position can be easily changed.

What is claimed is:

1. A golf club with a head body including a face for contacting a golf ball, a rear shell and a hollow region between said face and said rear shell, a shaft attachment portion provided on one side of the face of the head body, and a shaft connected to a tip end of said shaft attachment portion, wherein a head attachment portion extends inside said hollow region, said head attachment portion being connected to said shaft attachment portion.

2. A golf club according to claim 1, wherein said rear shell is formed by joining together a sole and side peripheral shell and a top shell.

3. A golf club according to claim 2, wherein said head attachment portion is fixed to a rear side of said face.

4. A golf club according to claim 3, wherein said head attachment portion extends from a base end of said shaft attachment portion, spanning approximately from a heel of said head body to a toe, and said shaft attachment portion is connected to said head body by means of said head attachment portion.

5. A golf club according to claim 4, wherein said head attachment portion is formed substantially horizontal.

6. A golf club according to claim 2, wherein said head attachment portion is formed into an approximate loop shape along an edge of said face.

7. A golf club according to claim 2, wherein said head attachment portion is fixed to an upper face of said sole.

8. A golf club according to claim 7, wherein said head attachment portion is provided rearwardly of said face.

9. A golf club according to claim 8, wherein said head attachment portion is formed substantially horizontal.

* * * * *